United States Patent [19]

Goss et al.

[11] 4,010,852

[45] Mar. 8, 1977

[54] SHEAVING ARRANGEMENT

[76] Inventors: John B. Goss, 7627 Beech Cove Lane; William D. Morrow, 10206 Amblewood, both of Houston, Tex. 77072; Jack W. Corbett, 210 E. Vermilion Parkway, Lafayette, La. 70501

[22] Filed: May 30, 1975

[21] Appl. No.: 582,185

[52] U.S. Cl. ..... 212/8 R; 212/59 R; 254/139.1

[51] Int. Cl.[2] ..... B66C 23/00

[58] Field of Search ..... 212/8 R, 9, 58 R, 58 A, 212/59 R, 3, 13, 41, 144; 254/188, 139.1

[56] References Cited

UNITED STATES PATENTS

| | | | |
|---|---|---|---|
| 483,161 | 9/1892 | Morgan | 254/188 |
| 1,928,958 | 10/1933 | Young et al. | 254/188 |
| 2,277,386 | 3/1942 | Brown | 254/188 |
| 2,960,310 | 11/1960 | Hull | 254/188 |
| 3,191,779 | 6/1965 | Thomson | 212/58 A |
| 3,294,262 | 12/1966 | Person | 212/8 R |
| 3,369,671 | 2/1968 | Yasukouchi | 212/59 R |
| 3,471,033 | 10/1969 | Drury | 212/8 R |
| 3,591,022 | 7/1971 | Gagarina et al. | 214/13 |
| 3,768,664 | 10/1973 | Bauer et al. | 212/58 R |

*Primary Examiner*—Robert J. Spar
*Assistant Examiner*—Lawrence J. Oresky
*Attorney, Agent, or Firm*—Pravel, Wilson & Gambrell

[57] ABSTRACT

In a crane having a boom, a load cable, a traveling block and multiple sheaves for the cable, an improved sheaving arrangement for preventing spinning of the traveling block and twisting of the cable when raising and lowering the traveling block.

9 Claims, 5 Drawing Figures

P
62
66a
66
40
38
24a
80
36
24
26
22
22b
B
32
42a
42
44
46
C
48
50
14a
U
16
14
4
5
5
56
22
26
30
28
52
54
20a
20
10
4
i
18
12
S
56b
56c
60d
64
60a
60
60c 66
68
P
62
72
78
78a
B
24
S
56e
56i
56c
56h
64
60d
60
70
60b
74
60a
60c 72
56g
76
68
62
S
66
56a
56d
56e
56b
56f
56c
56h
56i
70
74
64

30
34
54
58
B
28
28a
30
20a
32
56
54
52
52a
20

22a
B
22
22b

SHEAVING ARRANGEMENT

BACKGROUND OF THE INVENTION

The field of this invention is sheaving arrangements, particularly of the type used with cranes and the like.

In the raising and lowering of a load by use of a crane, it is not uncommon for the traveling block to spin and the cable twist when the traveling block carrying the load is moved about between various elevations. In particular, offshore platform cranes are typically utilized for moving loads from a lowermost level, such as on a ship on the surface of the water, to an uppermost level, such as on the surface of the offshore platform, with substantially all raising and lowering of such loads being below the level of the crane assembly in contradistinction to land-based cranes which typically move loads from ground level, adjacent the crane, to an upper, elevated level adjacent the boom of the crane. Due to the extended length of cabling necessary for proper offshore crane operation and in some instances proper land-based operation, extended lengths of cable are necessary resulting in increased probabilities that the traveling block with the load attached thereto may experience spinning with a resulting twisting of the cable supporting the same. This produces a potentially dangerous situation for the workers laboring in the vicinity thereof as well as an increased risk to damaging the machinery, load and any or all related facilities adjacent thereto.

SUMMARY OF THE INVENTION

The present invention relates to a new and improved sheaving arrangement for preventing spinning of the traveling block and twisting of the load hoist cable during raising and lowering of the traveling block. The improved sheaving arrangement of the present invention includes plural sheaves mounted with the boom point and at least one sheave mounted with the traveling block wherein a load hoist cable passes over the first fixed sheave mounted with the boom point to the first movable load sheave with the traveling block to the second fixed sheave located in proximity to the first fixed sheave but outwardly therefrom and in a plane substantially perpendicular to the plane of said first fixed sheave.

A further feature of the present invention includes mounting the load hoist with the boom for providing a fixed spaced relationship between the traveling block and the boom while raising and lowering the boom.

DESCRIPTION OF THE PREFERRED EMBODIMENT

Figure 1:
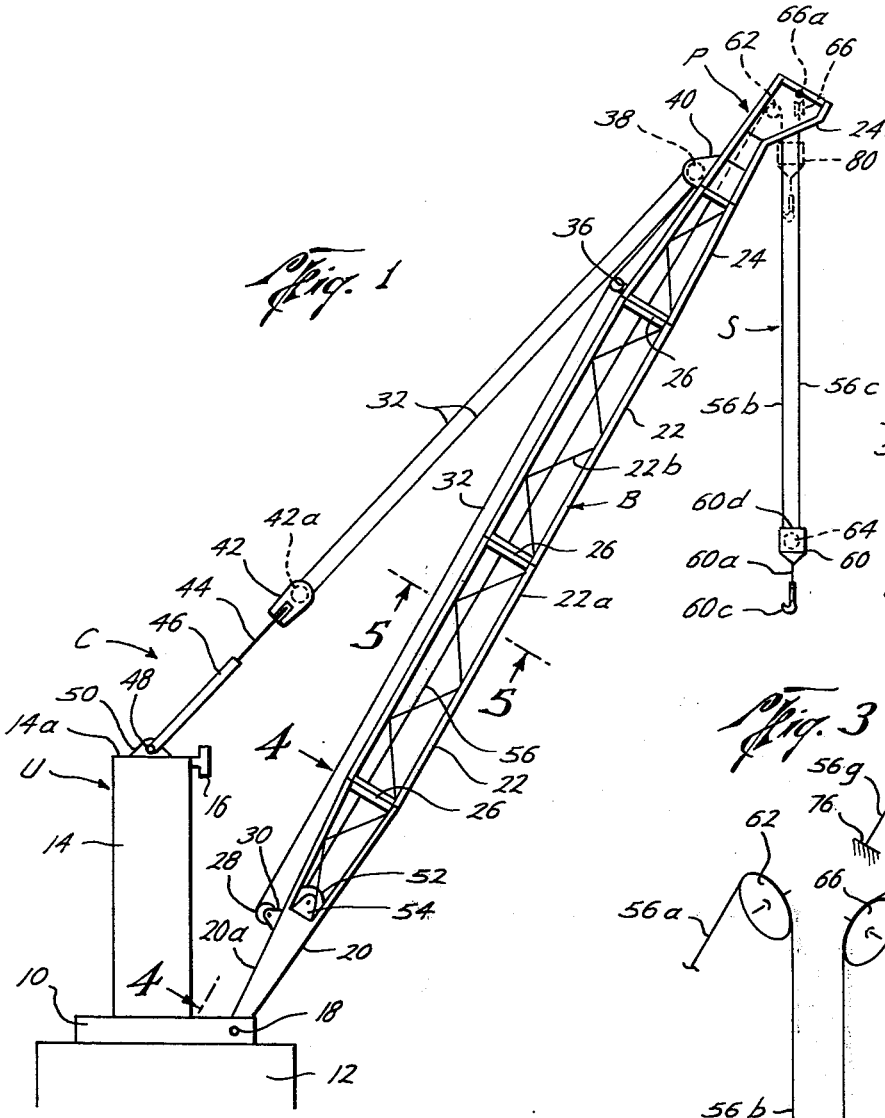
FIG. 1 is a side elevational view of a crane showing the improved sheaving arrangement of the preferred embodiment of this invention.
Figure 2:
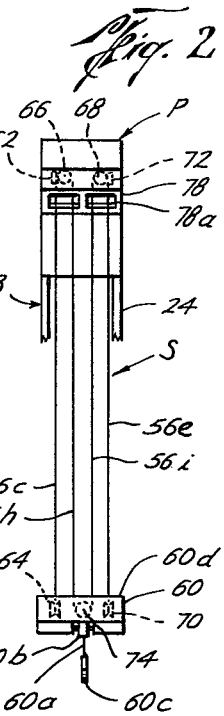
FIG. 2 is a front view, partly in section, showing the sheaving arrangement of the present invention.

Referring to the drawings, the letter S designates the sheaving arrangement of the preferred embodiment of this invention. The sheaving arrangement S is adapted to be mounted with a crane C. The crane C may be of a land-based tractor or truck-mounted variety or of a pedestal-type adapted to be mounted with an offshore platform. The crane C typically includes upperworks U having the boom B movably mounted therewith. Preferably, the sheaving arrangement S of the present invention is adapted to be mounted in part with the boom point P of the boom B.

As shown in FIG. 1, the crane C includes upperworks U. The upperworks U includes a platform 10 which is adapted to be mounted with the lowerworks 12 which may be the tractor-truck type arrangement of ground-based cranes as is well-known or of a pedestal-type as used with offshore platforms. A super-structure 14 is mounted with the platform 10 and provides an appropriate facility for positioning and locating the necessary controls for the crane C while the operator either stands on the platform 10 or in some suitable fashion positions himself within the super-structure 14. Mounted adjacent the upper portion of the super-structure 14 is a boom stop 16 which prevents the boom B from contacting the super-structure 14 when the boom B is disposed in a near vertical plane. The boom B is pivotally mounted with the platform 10 by boom foot 18 which pivotally connects the lowermost portion of the boom B with the platform 10.

The boom B is preferably of a segmented variety having a lower segment 20, intermediate segments 22, and upper segment 24. Preferably, the segments 20, 22, 24 are removably bolted together such that intermediate segments 22 may either be entirely removed or in the alternative an increased number of intermediate segments may be inserted therebetween lower segment 20 and upper segment 24 to either contract or expand the overall length of the boom B in response to the boom length requirements of any given particular job, as is well known in the art. Thus by inserting or removing intermediate segments 22 at boom splices 26, the overall length of the boom B may be suitably adjusted. The segments 22, 24 are preferably formed of longitudinally extending angle iron **22*a* or any other suitable material having appropriate bracing, such as brace 22*b*,** mounted therewith.

Figure 4:
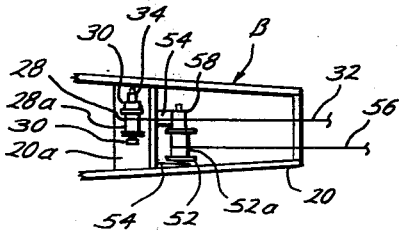
FIG. 4 is a sectional plan view of the boom of the crane as taken along the line 4—4 of FIG. 1; and, FIG. 5 is cross-sectional view of the boom of the crane as taken along the lines 5—5 of FIG. 1.

As shown in FIGS. 1 and 4, a boom hoist 28 is appropriately mounted with the upper surface platform **20*a* formed with the lower segment 20 of the boom B by appropriate mounting supports 30. Preferably, the boom hoist 28 includes a drum portion 28*a* which is adapted to receive the main boom hoisting cable 32. Preferably, a prime mover, which may be a hydraulically actuated fluid motor, an electric motor, or the like, is mounted adjacent thereto the boom hoist 28 rather than in the upperworks U for appropriately powering the same as discussed more fully hereinbelow. The main boom hoisting cable 32 extends from the boom hoist 28 over a suitable guide pulley 36 preferably mounted with the lower portion of upper segment 24 of the boom B thereinto a plural pulley arrangement which includes boom pulleys 38 appropriately mounted with the mid-portion of upper segment 24 of the boom B by supporting structures 40. Further, the cable 32 is connected to bridle 42 mounted with the upperworks U by boom suspension equalizer arms 44 mounted with supports 46 which in turn are pivotally mounted with the super-structure 14 by pins 48 being appropriately mounted with flanges 50 mounted with the upper portion 14***a* of the super-structure 14. Thus, the rigging of the boom hoist 28 allows raising and lowering of the boom B by actuating the boom hoist 28 which communicates a response to the main boom hoisting cable 32 which passes over guide pulley 36 thereinto boom pulleys 38 and therebetween pulleys 42*a* mounted with bridle 42 such that the boom B may be raised by appropriately winding main boom hoisting cable 32 thereon drum 28*a* of the boom hoist 28 or alternatively lowered by allowing the main boom hoisting cable 32 to reel from the boom hoist 28.

A load hoist 52 is preferably mounted with the lower segment 20 of the boom B by means of appropriate support flanges 54. The load hoist 52 may be of any suitable variety but preferably includes a drum 52*a* adapted to receive load hoist cable 56 in such a fashion that the load hoist cable 56 may be reeled onto and off of the drum 52*a* of the load hoist 52. The load hoist 52 is preferably powered by prime mover 58 which may be a hydraulically actuated motor, an electric motor, or any other suitable driving means for imparting rotational force to the drum 52*a* of the load hoist 52. Furthermore, it should be noted that the load hoist 52 is mounted within the interior portion of the lower segment 20 such that the load hoist cable 56 extends therefrom within the interior portion of the boom B along its longitudinal axis as is described more fully hereinbelow.

Figure 3:
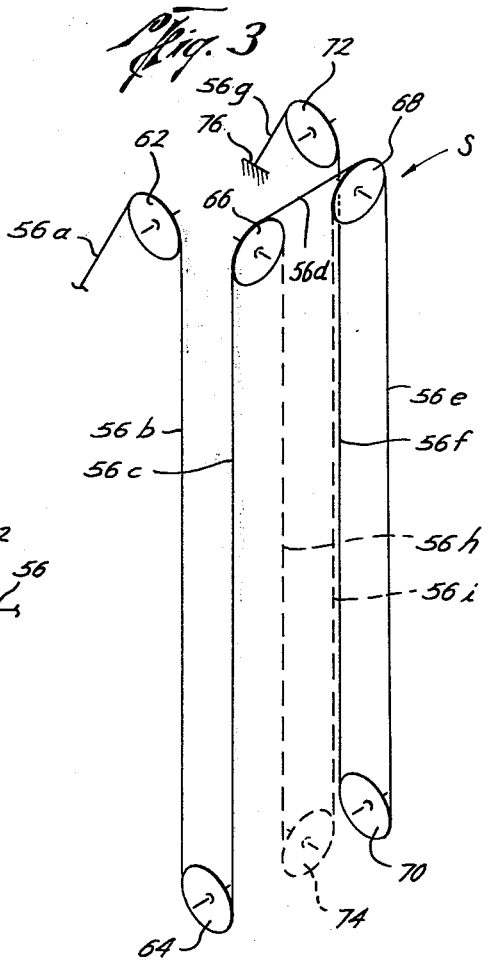
FIG. 3 is a schematic, isometric view of the preferred embodiment of the sheaving arrangement of the present invention.

The sheaving arrangement S of the present invention is preferably mounted with the boom point P of the boom B and with the spreader or traveling block 60. The sheaving arrangement S of the present invention is schematically shown in FIG. 3. A first fixed sheave 62 is mounted with the boom point P and receives cable portion 56*a* of the load hoist cable 56 that extends therebetween the load hoist 52 and the first fixed sheave 62. A first movable load sheave 64 is appropriately mounted with the traveling block 60 and receives cable portion 56*b* that extends therebetween the first fixed sheave 62 and the first movable load sheave 64. Both the first fixed sheave 62 and the first movable load sheave 64 are mounted in a first plane that is substantially parallel to the longitudinal vertical axis of the boom B. A second fixed sheave 66 is mounted in proximity to the first fixed sheave 62 with the boom point P but outwardly therefrom the first fixed sheave 62. The second fixed sheave 66 is pivotally mounted with the boom point P at pivot point 66*a* (FIG. 1) to allow sheave 66 to be substantially vertically disposed with respect to the horizontal irrespective of the particular angle at which the boom B is disposed with respect to the horizontal. The second fixed sheave 66 is mounted with the boom point P in a plane that is substantially perpendicular to the first plane and receives cable portion 56*c* extending therebetween first movable load sheave 64 and second fixed sheave 66. The second fixed sheave 66 is laterally spaced from the first fixed sheave 62 a distance at least approximately equal to the diameter of the first movable load sheave 64 for thereby spacing the cable portions 56*b*, 56*c* from the first movable load sheave 64 apart such distance to prevent spinning of the traveling block 60 and twisting of cable portions 56*b*, 56*c* when raising and lowering the traveling block 60. In such a configuration, with the first plane being substantially parallel to the longitudinal vertical axis of the boom B and the second plane being substantially perpendicular thereto, both planes intersect substantially along cable portion 56*c* passing from the first movable load sheave 64 to the second fixed sheave 66.

A third fixed sheave 68 is pivotally mounted with the boom point P in a similar fashion as second fixed sheave 66. The third fixed sheave 68 is affixed with the boom point P substantially in the second plane and in substantial radial alignment with and adjacent to the second fixed sheave 66 and receives cable portion 56*d* passing from the second fixed sheave 66 thereto third fixed sheave 68. A second movable load sheave 70 is mounted with the traveling block 60 being in substantially axial alignment with and adjacent to the first movable load sheave 64. The second movable load sheave 70 is in a third plane substantially parallel to the first plane and spaced apart therefrom at least substantially the sum of the diameters of the second and third fixed sheaves 66, 68. The second movable load sheave 70 receives cable portion 56*e* from the third fixed sheave 68 and which extends thereto.

A fourth fixed sheave 72 is mounted adjacent to and in substantial axial alignment with the first fixed sheave 62 being mounted in the third plane which is parallel to the first plane. The fourth fixed sheave 72 receives cable portion 56*f* passing from the second movable load sheave 70 thereto. It should be noted that preferably, the second plane and the third plane intersect substantially along cable portion 56*e* which passes from the third fixed sheave 68 to the second movable load sheave 70. Cable portion 56*g* extends from the fourth fixed sheave 72 and is appropriately statically mounted with the boom B at point 76.

An alternative configuration for extremely heavy loads and increased mechanical advantage of the sheaving arrangement S of the present invention includes removal of cable portion 56*d* and including a third movable load sheave 74 mounted with the traveling block 60 therebetween the first and second movable load sheaves 64, 70 with the third movable load sheave 74 being mounted in the second plane in radial alignment with the axes of sheaves 64, 70 and receiving cable portion 56*h* therefrom the second fixed sheave 66 which extends therearound the third movable load sheave 74 and having cable portion 56*i* passing therefrom to the third fixed sheave 68.

Pendant 60*a* is appropriately pivotally mounted with the traveling block 60 by means of the pivot-pin arrangement 60*b* for pivotally mounting a swivel hook 60*c* therewith for engaging any load that must be raised and/or lowered by the crane C.

In the use or operation of the sheaving arrangement S of the present invention, it is intended that in response to changes in the length of load hoist cable 56, the load (not shown) will be appropriately lowered when the load hoist drum 52*a* is unreeled and/or raised when the load hoist drum 52*a* is reeled up. As shown in FIG. 3, an urging of cable portion 56*a* results in a reaction upon the movable load sheaves 64, 70 (in the alternative, also 74) resulting in an elevational response of the traveling block 60. Due to the particular spaced relation of the sheaves 62, 64, 66, 68, 70, 72, and 74 with the appropriate cable portions therebetween, elevational changes in the traveling block 60 result without spinning thereof and without twisting of the cable 56 during raising and/or lowering of the traveling block 60 from extremes in elevation.

Figure 5:
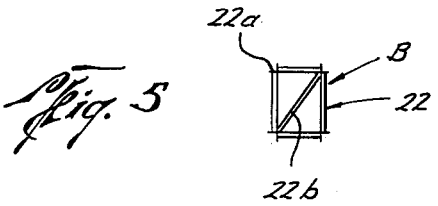

The boom B is preferably of a constant cross-sectional width as depicted in FIG. 5 along segments 22 and has no taper along its cross-sectional width. This constant cross-sectional width configuration extends to and includes the upper segment 24 adjacent the boom point P. This feature allows the disposition of cable 56 entirely within the framework of the boom B in a protected position as well as providing for substantially radial alignment of the drum 52*a* and the sheave 62 having cable portion 56*a* therebetween along the longitudinal axis of the boom B.

At the boom point P, surface 24*a* provides a mounting location for plate 78 having suitable openings 78*a* for allowing the appropriate cable portions of cable 56 to extend therethrough to the traveling block 60. The plate 78 being of substantially the same width as that of the boom B is of lesser girth than the width of the traveling block 60 and is a positive surface used as a stop means should the traveling block 60 be inadvertently pulled to the boom point P as shown as position 80 in FIG. 1. As such, the plate 78 prevents damage to the sheaves 62, 66, 68, 72 in the boom point P by positively preventing the traveling block 60 from engaging the same. The top surface 60*d* of traveling block 60 engages the plate 78 thus also protecting sheaves 64, 70, 74 within the traveling block 60 from damage. Thus, "two blocking" is eliminated and in the event that the traveling block 60 does in fact contact the plate 78, due to the design criterion involved pertaining to the load hoist 52, it is preferred that the drum 52*a* will stall without damaging the hoisting cable 56, boom B or traveling block 60.

Furthermore, due to the positioning of the load hoist 52 within the boom B, the old problem of "booming down" into the traveling block 60 is virtually eliminated. Prior art devices typically have the load hoist 52 mounted within the upperworks, resulting in elevation changes of the traveling block 60 with respect to the boom point P while the boom B is raised or lowered, independent of actuation of the load hoist, due merely to the changes in inclination of the boom B. This is due to a constantly changing angle of the cable from the upperworks U to the boom B, hence the length of the cable is always changing as the boom angle changes. The present invention preferably includes mounting the load hoist 52 on the boom B. With the load hoist 52 on the boom B, no elevational changes result between the traveling block 60 and the boom point P when the boom B is being lowered in response to actuation of boom hoist 28 inasmuch as the load hoist 52 is independent of the upperworks U of the crane C.

Furthermore, the lateral spacing of fixed sheaves 62, 72 from fixed sheaves 66, 68 permits substantially near vertical disposition of the boom B without the cable 56 and traveling block 60 inadvertently contacting the boom B. Also the spread out configuration of all cable portions of cable 56 stabilizes the traveling block 60 during up and down movement thereof, preventing spinning of the traveling block 60 and twisting of cable portions 56*b*, 56*c*, 56*e*, 56*f*, 56*h*, 56*i*, particularly when the load is picked up and released at levels substantially below the horizontal plane of the crane C.

The foregoing disclosure and description of the invention are illustrative and explanatory thereof, and various changes in the size, shape and materials as well as in the details of the illustrated construction may be made without departing from the spirit of the invention.

We claim:

1. A crane having a boom with a boom point at the extremity thereof, a load hoist cable, a load hoist, a traveling block and multiple sheave means for said cable, the improvement residing in said sheave means, comprising:

first fixed sheave means located with the boom point of said boom over which said cable passes from said load hoist;

first movable load sheave means mounted with said traveling block about which said cable passes from said first fixed sheave means;

second fixed sheave means located in proximity to said first fixed sheave means with said boom point but outwardly from said first fixed sheave means;

said first fixed sheave means mounted adjacent the boom point of said boom in a first plane substantially parallel to the longitudinal axis of said boom;

said second fixed sheave means being in a plane substantially perpendicular to said first plane;

third fixed sheave means mounted adjacent the boom point substantially in said second plane in substantial radial alignment with and adjacent to said second fixed sheave means and receiving said cable passing from said second fixed sheave means;

second movable load sheave means mounted with said traveling block in substantial axial alignment with and adjacent to said first movable load sheave means in a third plane substantially parallel to said first plane and spaced apart therefrom at least substantially the diameters of said second and third fixed sheave means, said second movable load sheave means receiving said cable from said third fixed sheave means;

fourth fixed sheave means mounted adjacent to and in substantial axial alignment with said first fixed sheave means in said third plane and receiving said cable from said second movable load sheave means; and, said second and third fixed sheave means, respectively, being laterally spaced from said first and fourth fixed sheave means, respectively, a distance approximately equal to the diameter of said first and second movable load sheave means, respectively, for thereby spacing the cable lengths from said first and second movable load sheave means, respectively, apart such distance to prevent spinning of said traveling block and twisting of said cable when raising and lowering said traveling block.

2. The improvement of claim 1, wherein:

said first plane and said second plane intersect substantially along said cable passing from said first movable load sheave means to said second fixed sheave means; and, said second plane and said third plane intersect substantially along said cable passing from said third fixed sheave means to said second movable load sheave means.

3. The improvement of claim 1, further including:

a third movable load sheave means mounted with said traveling block therebetween said first and second movable load sheave means; and said third movable load sheave means mounted in said second plane and receiving said cable from said second fixed sheave means, therearound said third load sheave means and passing therefrom to said third fixed sheave means.

4. The improvement of claim 1, wherein:

said second and third sheave means are pivotally mounted with said boom point.

5. The improvement of claim 1, wherein:

said load hoist for said cable is mounted on said boom for substantially parallel alignment of said cable with the longitudinal axis of said boom along the length of said boom for providing a fixed spaced relationship between said traveling block and said boom point while raising and lowering said boom.

6. The improvement of claim 5 wherein the crane further has an upperworks for pivotally mounting said boom, wherein:

said load hoist is mounted within said boom adjacent the pivot point of said boom with said upperworks.

7. The improvement of claim 1, wherein:

the longitudinal cross-sectional width of said boom is substantially constant and non-tapering.

8. The improvement of claim 1, further including:

stop means mounted with said boom point below said fixed sheaves to prevent said traveling block from engaging said fixed sheaves.

9. The improvement of claim 1, wherein:

said lateral spacing of said first and fourth fixed sheave means and said second and third fixed sheave means permits substantially near vertical disposition of said boom without said cable and said traveling block contacting said boom.

* * * * *